United States Patent [19]

Patterson

[11] Patent Number: 4,595,204

[45] Date of Patent: Jun. 17, 1986

[54] DEVICE FOR PRACTICING GOLF CLUB SWING

[76] Inventor: George H. Patterson, 80 Van Greenby Rd., Lowell, Mass. 01851

[21] Appl. No.: 751,244

[22] Filed: Jul. 2, 1985

[51] Int. Cl.[4] ..... A63B 69/36

[52] U.S. Cl. ..... 273/186 A; 273/186 C; 273/194 R

[58] Field of Search ..... 273/183 D, 186 A, 186 C, 273/193 R, 194 R, 194 B, 29 A, 26 B, 162 E, 162 R, 165; 434/252

[56] References Cited

U.S. PATENT DOCUMENTS

| | | | |
|---|---|---|---|
| 1,634,887 | 7/1927 | Rigby | 273/81.2 |
| 3,833,223 | 9/1974 | Shulkin | 273/194 R |
| 3,918,721 | 11/1975 | Trask | 273/186 A |
| 3,954,271 | 5/1976 | Tredway | 273/186 A |

*Primary Examiner*—George J. Marlo
*Attorney, Agent, or Firm*—Pearson & Pearson

[57] ABSTRACT

A device for practicing the swing of a playing instrument such as a golf club is an elongated extension removably attached to the handle of the club to normally extend upwardly under the left arm pit to a level about the level of and behind the shoulders. The extension is lightweight of hollow plastic tubing and has a socket at the lower end which slides over the upper part of the club handle. A centering pin in the socket enters the vent hole, which is in the butt of most golf clubs, to guide and center the extension as the socket is removably clamped in place. As the golfer performs his back stroke, then his forward stroke, and then follows through in simulating striking the ball, the extension will indicate to him that he is stroking correctly. The extension is about the same length as a golf club to be carried in the golf bag when not in use. An arrow on the extension tells the golfer where to place his thumb. A projecting pin, on the extension, points to the ground when the extension is at the finish of the back swing.

11 Claims, 12 Drawing Figures

DEVICE FOR PRACTICING GOLF CLUB SWING

BACKGROUND OF THE INVENTION

There have been numerous books, films, tapes, and mechanical devices provided in the prior art, in addition to the coaching of golf professionals and amateurs for teaching the proper swing of a golf club to attain maximum distance or accuracy.

In U.S. Pat. No. 1,983,329 to Wallace, et al of Dec. 4, 1934, a mechanical figure, or robot, combined with an oblique display panel, is provided with movable arms which exemplify the various positions of a golfers arms, wrists, and club in slowly swinging through a perfect golf club stroke.

U.S. Pat. No. 2,498,006 to Ridill of Feb. 20, 1980 suggests a training device for golfers consisting of an elongated coil spring connecting the wrist to the foot of the golfer.

A long rigid rod extends between the crooks of the elbows, and across the back as the player swings the rod as a simulated golf club in U.S. Pat. No. 3,109,244 to Triparo, et al of Nov. 5, 1963.

In U.S. Pat. No. 3,595,583 to Oppenheimer of July 27, 1971, FIG. 8, the lower end of a rigid rod is pivotally attached at an angle below the grip to the club and extends upwardly to a shoulder harness there being a swivel joint in the assembly.

SUMMARY OF THE INVENTION

In this invention, there are no coil spring harnesses to the foot, or shoulder harness supports, and the golf swing practice device is carried in the golf bag for slidable affixation on the handle, or grip, of one of the golf clubs when stroke practice is desired.

The golf stroke practice device is preferably a hollow tube of light weight plastic, ranging in length from about eighteen inches to thirty-six inches, depending on whether for a child's club, a woman's club, or a man's club, but capable of easily fitting in a golf club bag with the clubs.

Unlike the above mentioned Oppenheimer device, it is provided with non-pivotable, removable, affixation means so that it fits over the butt end of the handle, or grip, of the golf club, preferably in straight line extension of the straight shaft of the club. It extends upwardly under the left arm, under the left arm pit, to about the level of the rear of the left shoulder when the golfer is in normal golf ball addressing stance.

The affixation means preferably consists of at least two oppositely disposed, longitudinally extending slits at the end sleeved over the club handle, the slits being preferably about four inches in length and forming tongues which are compressed or clamped inwardly by a resilient, annular ring, slidable on the outer surface of the slit end.

At least 95% of golf clubs contain a vent hole in the center of the butt end of the club handle, and the affixation means of the invention includes a plug adhered in place within the hollow tubular extension, about four inches from the outer flared openings of the slits, the plug being at the base of the slits. A pin is adhered along the longitudinal center line of the plug to extend toward the opening and to enter the vent hole to guide and center the extension as it is sleeved over the club handle, or grip.

The grip portion of the club handle is partially covered by the slit end of the tubular extension, so that preferably a non-slip, friction surface is provided on the exterior surface of the split end to prevent slippage of the hands.

One of the two or more tongues which form the inner end or compressible socket end of the extension is provided with an arrow which tells the user where to put his thumb in properly gripping the club, the arrow pointing directly down to the head of the club. At the other, or outer, end of the extension, a pin projects outwardly about one inch as an indicator to point directly to the ground when the club and extension are at the top of the backswing.

DESCRIPTION OF A PREFERRED EMBODIMENT

Figure 2:
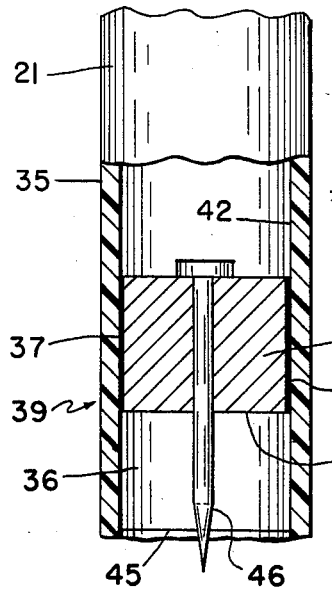
FIG. 2 is an enlarged, fragmentary, view in half section of one form of affixation means of the invention.
Figure 1:
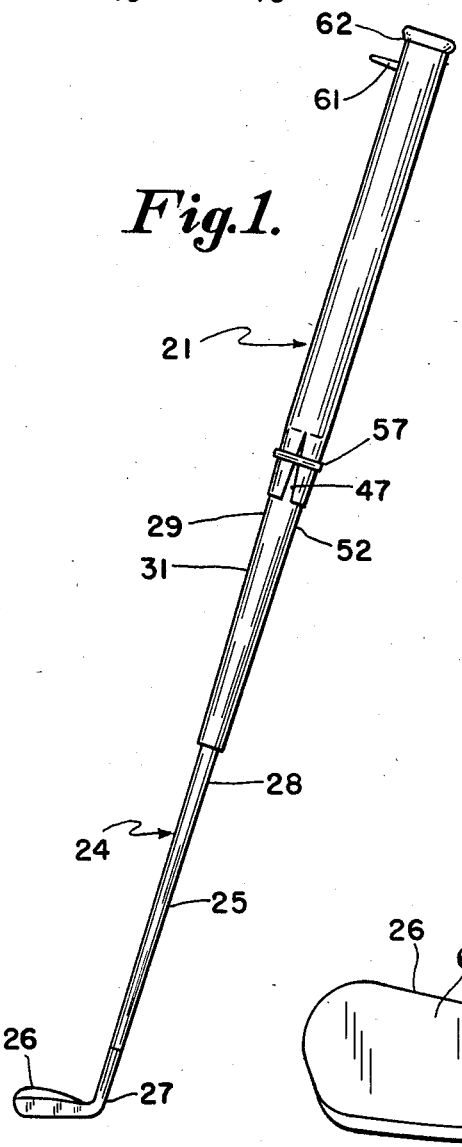
FIG. 1 is a side elevational view of a typical golf club with the extension of the invention temporarily affixed to the grip.

The practice device 21 of the invention is for use by a person 22, such as a golfer 23, (FIGS. 5–11), in practicing to improve his swing of a club-like instrument 24 such as a typical golf club 25. The term instrument is used to include a similar device, removably attached on the end of a baseball bat, polo mallet, or the like.

Figure 5:
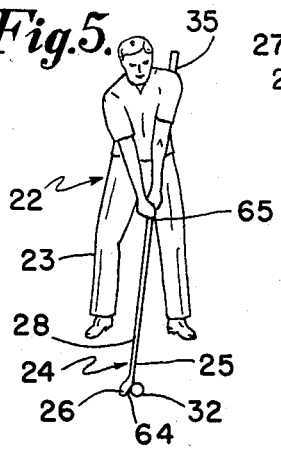
FIGS. 5, 6, 7, 8, 9, 10 and 11 are front elevational views, on a reduced scale showing successive stages of practice of club swing by a golfer.

The golf club 25 includes a club head 26, at the distal end 27, separated by the straight, elongated shaft 28, from the handle, or grip 29, at the proximal end 31, the golfer being shown in normal stance addressing the golf ball 32, in FIG. 5. At least 95% of golf club handles, or grips, include a vent hole 33 in the exact center of the butt 34 of the grip or handle 29.

The practice device 21 of the invention is preferably an elongated straight, hollow tube 35, of light weight plastic 30, removably affixed over the proximal end 31 of a golf club 25, preferably in straight line extension of the straight shaft 28. It is produced in lengths which range from eighteen inches for a child's golf club, through an intermediate length for a ladies golf club, to a length of about thirty-six inches for a man's golf club. The extension tube 35 has an inside diameter in the range of 25 mm to 30 mm.

The extension 35 is provided with a socket 36 at its inner end 37, which is the end proximate the grip, or handle 29, for slidably receiving the end portion 38 of the grip and forms part of the affixation means 39. The socket 36 may be formed by a plug 41, fixed within the inner wall 42 by adhesive 43, to form the base 44 of the socket. As shown in FIG. 2, the socket 36 may be relatively shallow, for example, three quarters of an inch in depth, from the opening, or mouth 45, and a centering pin 46 is fixed along the longitudinal center line of the plug 41 to enter the vent hole 33 in the butt 34.

Figure 4:
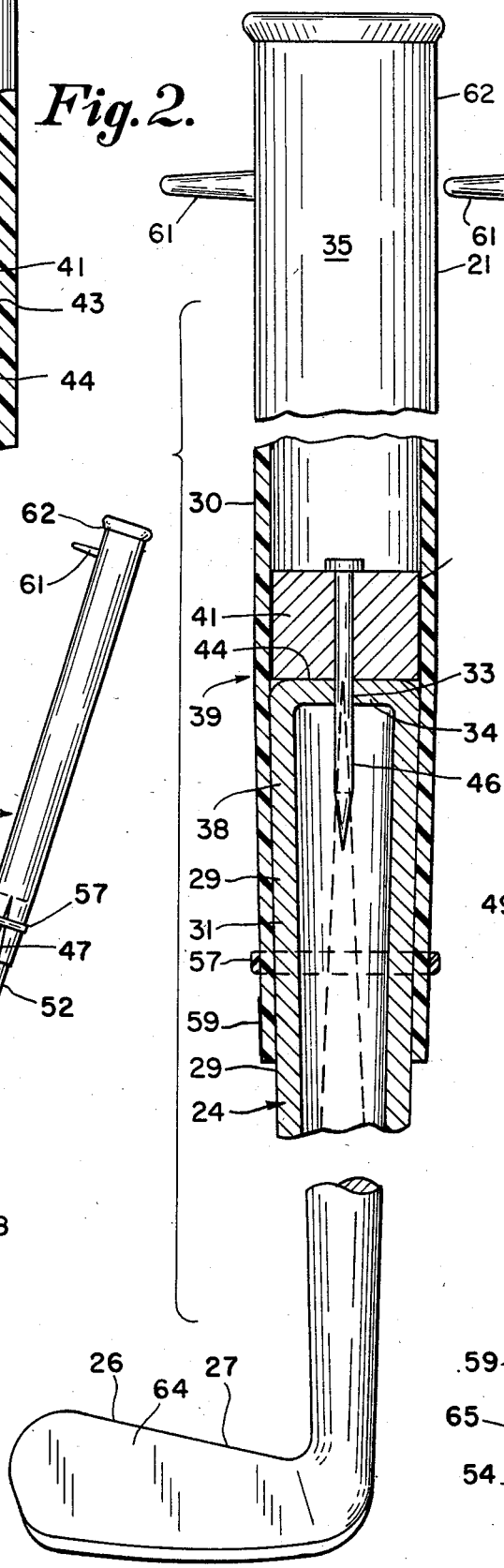
FIG. 4 is a view similar to FIG. 3 showing the tubular extension of the invention removably clamped on the grip of a golf club, with parts broken away and in half section.
Figure 3:
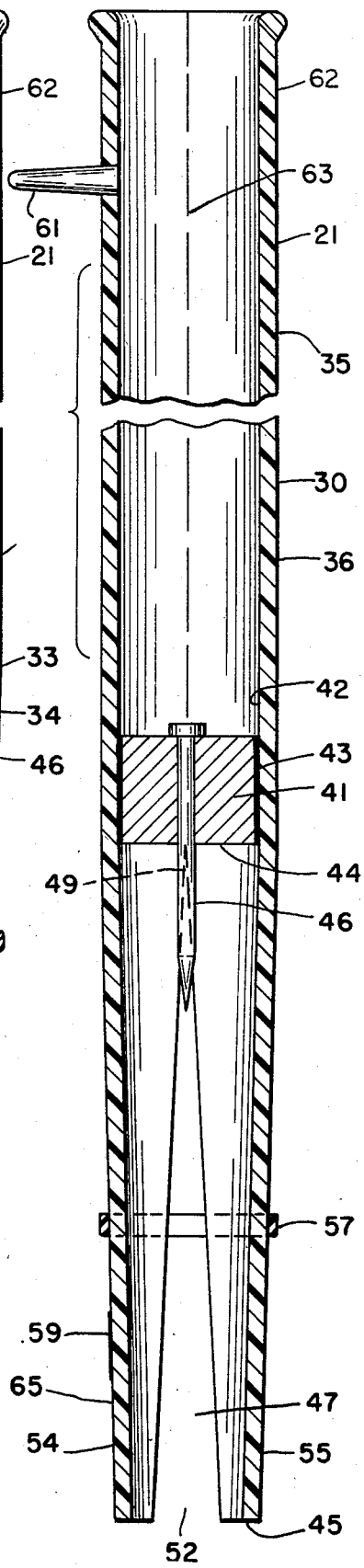
FIG. 3 is an enlarged, side elevation, in half section of the preferred form of affixation means of the invention.
Figure 12:
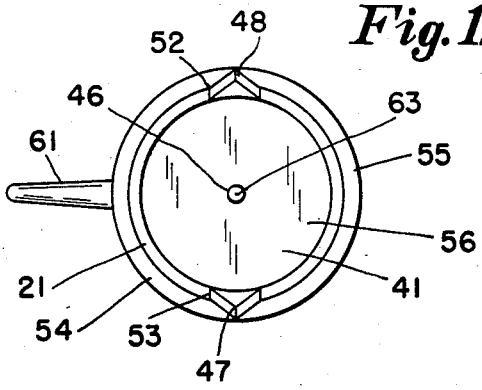
FIG. 12 is an end view of the proximal end of the tubular extension of the invention showing two slits forming two tongues, the plug, the central affixation pin, and the projecting pin.

A preferred embodiment of the affixation means 39 of the practice device of the invention is shown in FIGS. 3, 4, and 12 wherein the plug 41, and centering pin 46 have been affixed to inner wall 42 about four inches back from the mouth, or opening 45 of the hollow, tubular extension 35. At least two oppositely disposed, longitudinally extending, normally open slits 47 and 48, are spaced around the inner handle end 37 of the tube, each about four inches long and each flaring outwardly from the slit base, such as 49, at the socket base 44, formed by the plug 41, to a wider mouth such as 52 or 53 at the tube mouth, or opening 45. As shown in FIG. 12, these spaced slits form at least two normally spaced, resilient, compressible tongues 54 and 55 which permit the socket 56 to expand for slidable sleeving over the end portion 38 of a club handle or grip 29, until the pin 46 enters the vent hole 33, for firm support and seating, whereupon the resilient, annular, rubber element 57, on the exterior surface 58, of the tube is slid over the tongues 54 and 55 to clamp them around the handle.

The center pin 46 is preferably tapered from its base within the plug 41, to a relatively sharp tip, or point, and may be a 6 penny to a 16 penny nail.

As shown in FIGS. 5–11, the extension 35 is of sufficient length to extend from the club grip, or handle 29, under the left arm and under the left arm pit to a level about the level of the rear of the left shoulder of the golfer when in golf ball addressing stance (FIG. 5). It remains in straight line extension of the shaft of the club as the golfer simulates the back stroke, the ball impact stroke and the follow through stroke.

An arrow 59 is embossed or otherwise provided on the exterior surface 58 of the tube, on one of the tongues 54 or 55, to indicate to the golfer where to put his thumb when he grips the golf club handle 29. The thumb is placed just below the arrow 59. The arrow points directly down to the head of the club.

A pin 61 projects about one inch from near the outer end 62 of the extension 35, in a directional normal to the longitudinal, central axis 63 of the extension. Pin 61 points directly to the ground when the extension is at the top of the backswing.

In FIG. 5 a typical right handed golfer is shown assuming a normal stance grip and pre-swing posture. The arrow 59 points down the club shaft to the club head. The pointer pin 61 points slightly upward toward a plane directly over and parallel to the club face 64.

Figure 6:
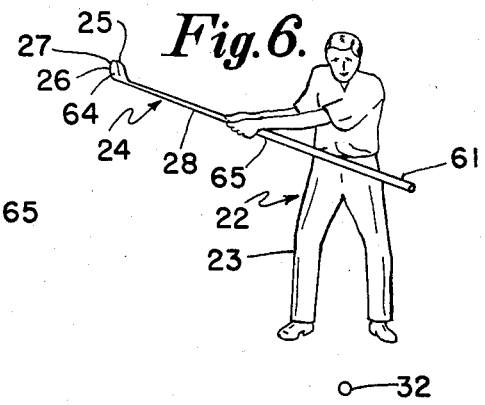
Figure 7:
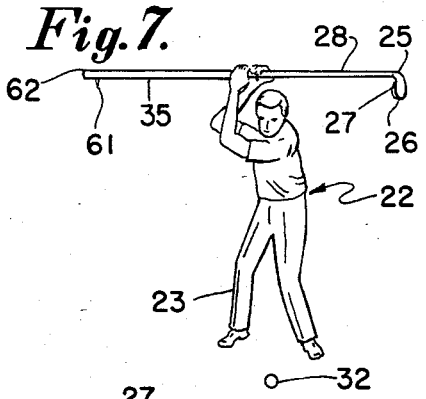

In FIG. 6 the golfers backswing is shown, it being slower than normal. At the finish of the backswing, shown in FIG. 7, the pointer pin 61 will indicate the position of the face 64, or hitting surface, of the golf club 25, and the club and extension are parallel to the ground and pointing in a line parallel to the target.

Figure 8:
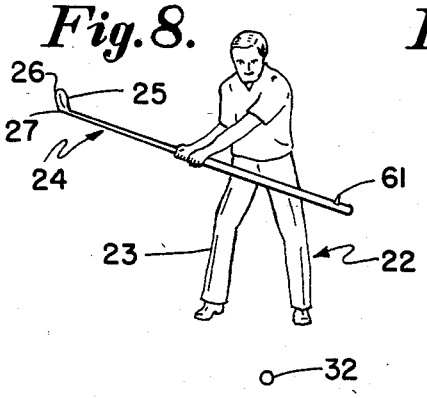
Figure 9:
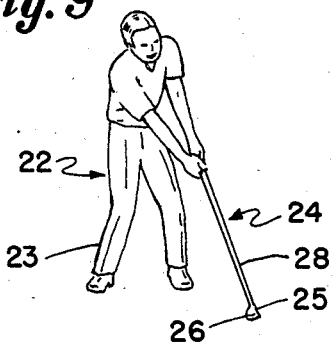

The downswing is shown in FIG. 8, the right elbow being dropped by the pull of the left arm and both arms are fully extended at the bottom of the downswing or impact area (FIG. 9). At this time the weight of the golfer's body is shifted from the right foot to the left foot.

Figure 10:
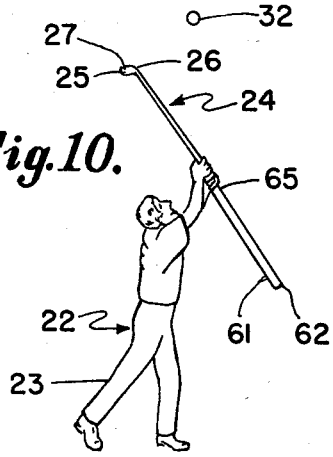
Figure 11:
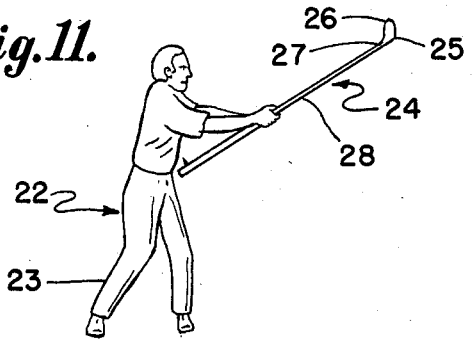

The follow through is shown in FIG. 10 with the arms fully extended out past the left side of the body and the right wrist and forearm rolled over the left wrist and forearm so that, at the finish, the outer end 62 of the extension 35, is pointing at the target. The extension may slightly brush the left side of the body at the beginning of the follow through.

In addition to the arrow 59, the exterior surface 58 of the inner end 37 of the extension 35, in the socket area which will be gripped by the user, has a non-friction surface 65 to prevent slippage. Surface 65 may be a paper label or may be the plastic material 30 slightly roughened.

A slightly angular, bent extension would fall within the scope of some of the claims hereof, but an extension which is in straight line extension of the straight shaft of the golf club has been found much preferable.

I claim:

1. A practice device, for use by a person in swinging an elongated club-like instrument of the type having a shaft with a distal end for striking a ball and a proximal end with an elongated handle, the handle having an end portion and a centrally located vent hole in the butt thereof;

said device comprising an elongated, lightweight tubular member adapted to form an extension of said shaft, having an inner end and an outer end, said extension being of sufficient length to normally extend from its inner end proximate the end portion of said club handle, upwardly under the left arm pit to its outer end in rear of the left shoulder of the person using said device;

affixation means at the said inner end of said extension, including a socket for receiving the end portion of the handle of said shaft and removably clamping said end portion in said socket, and including an axially extending, central pin adapted to slidably fit in said vent hole.

2. A combination as specified in claim 1 wherein:

said socket at said inner end of said extension includes at least two, oppositely disposed, longitudinally extending, tongues formed by at least two normally open slits each tongue and slit being between two to four inches long; and a resilient elastic ring slidably mounted around said socket to resiliently close said slits and compress said tongues around end portion of said handle.

3. A combination as specified in claim 1 wherein:

said extension is a hollow straight plastic tube;

said socket at said inner end of said extension includes at least two longitudinal tongues formed by two longitudinal slits and an encircling elastic ring for clamping said tongues around said end portion of said handle;

and said socket at said inner end includes an interior plug affixed at the base of said slits and said axially extending pin is affixed in said plug and adapted to enter the vent hole in said end portion of handle to guide and center said extension.

4. A golf practice device for use with a golf club having a head, a shaft, a handle and a vent hole in the butt of the handle, said device comprising:

a member adapted to form a straight line extension of said golf club shaft, formed of hollow, tubular, light weight plastic material of sufficient length to extend from the golf club handle up under the arm pit to about the level of the rear of the shoulder of the user when in practice position, said extension having an inner end and an outer end;

and affixation means including a split socket at the inner end of said extension, resilient means for clamping said split socket over the end portion of said club handle and a centering pin adapted to slidably enter said vent hole, for removably attaching said extension over the handle of said golf club during practice, but enabling removal and storage thereof, in the golf bag, when not in use.

5. A golf practice device as specified in claim 4 wherein:

said affixation means includes a plug adhered within said inner end and forming the base of said socket, and said centering pin is affixed within said plug in position to enter said vent hole to guide and center said socket.

6. A golf practice device as specified in claim 4 wherein:

said inner end of said extension which includes said socket, includes at least two symmetrically arranged, longitudinally arranged slits spaced therearound and forming at least two movable tongues and includes a resilient, elastic ring encircling said tongues;

whereby said affixation means is resiliently expandable and compressible to fit golf club handles of various diameter.

7. A golf practice device as specified in claim 4 wherein:

said affixation means includes a plug adhered to the inside of the said inner end of said hollow tubular extension to form the base of said socket, about two to six inches from within the opening of said socket;

said plug includes a centering pin adhered centrally therewithin and extending out to the opening of the socket and adapted to enter said vent hole in the butt of a golf club handle and said inner end contains a plurality of longitudianlly extending tongues formed by a plurality of longitudinally extending slits extending from said plug to said socket opening and a resilient elastic ring encircling said inner end at said slits for compressing said inner end around golf club handles of various diameters.

8. A golf club practice device as specified in claim 7 wherein:

the said inner end of said extension in the area of said socket, plug, ring and slits has a friction, roughened surface for engaging the hands of the user without slippage.

9. A golf club practice device as specified in claim 7 wherein:

said slits are flared outwardly in width from the base thereof at said plug to the mouth thereof at the opening of said socket and said centering pin has a relatively sharp point.

10. A golf club practice device as specified in claim 7 wherein:

said extension is between 18 inches to 36 inches in length, the extension has an inside diameter which is in the range of 25 mm to 30 mm, the centering pin is a nail in the range of 6 penny to 16 penny size and said slits are about four inches in length.

11. A golf club practice device as specified in claim 7, plus:

a pointer pin extending laterally from proximate the outer end of said extension in a direction substantially normal to the central longitudinal axis of said extension.

* * * * *